US006363767B1

(12) United States Patent
Papazian et al.

(10) Patent No.: US 6,363,767 B1
(45) Date of Patent: Apr. 2, 2002

(54) SYSTEM AND METHOD FOR FORMING SHEET METAL USING A RECONFIGURABLE TOOL

(75) Inventors: John M. Papazian, Great Neck; Jerrell A. Nardiello, Hicksville; Robert C. Schwarz, Huntington; John Melnichuk, Bethpage, all of NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/514,983

(22) Filed: Feb. 29, 2000

(51) Int. Cl.[7] ..... B21D 37/00
(52) U.S. Cl. ..... 72/413; 72/297
(58) Field of Search ..... 72/296, 297, 302, 72/413

(56) References Cited

U.S. PATENT DOCUMENTS

| | | | | |
|---|---|---|---|---|
| 339,804 A | | 4/1886 | Norwood | |
| 2,280,359 A | | 4/1942 | Trudell | 113/44 |
| 2,371,587 A | * | 3/1945 | Seifried | 72/296 |
| 2,783,815 A | | 3/1957 | Tegarden | 153/51 |
| 3,575,031 A | | 4/1971 | Gray | 72/302 |
| 4,116,038 A | | 9/1978 | Berthou | 72/413 |
| 5,125,252 A | | 6/1992 | Ayres et al. | 72/157 |
| 5,187,969 A | | 2/1993 | Morita | 72/413 |
| 5,546,784 A | * | 8/1996 | Haas et al. | 72/413 |
| 5,807,454 A | | 9/1998 | Kawabe et al. | 156/214 |
| 5,878,619 A | | 3/1999 | Walczak | 72/478 |
| 5,954,175 A | | 9/1999 | Haas et al. | 192/48.2 |
| 6,012,314 A | | 1/2000 | Sullivan et al. | 72/14.8 |
| 6,053,026 A | * | 4/2000 | Nardiello et al. | 72/413 |

FOREIGN PATENT DOCUMENTS

| | | |
|---|---|---|
| FR | 993104 | 10/1951 |
| FR | 1178330 | 5/1959 |
| JP | 07290149 | 11/1995 |
| JP | 10225734 | 8/1998 |
| WO | WO 96/17697 | 6/1996 |

OTHER PUBLICATIONS

PCT International Search Report mailed Jun. 22, 2001, regarding PCT/US/01 01747.

Walczyk, et al., "Development of a Reconfigurable Tool for Forming Aircraft Body Panels," *Journal of Manufacturing Systems*, vol. 17/No. 4 (pp. 287–296), 1998.

Walczyk, et al., "A Comparison of Rapid Fabrication Methods for Sheet Metal Forming Dies," *ASME Journal of Manufacturing Science and Engineering*, 1998.

Papazian, et al., "Reconfigurable Tooling for Sheet Metal Forming," *The Minerals, Metals & Materials Society*, 1999.

* cited by examiner

*Primary Examiner*—David Jones
(74) *Attorney, Agent, or Firm*—Terry J. Anderson

(57) ABSTRACT

A system for forming sheet metal (118) is disclosed. The system comprises a support plate (102) that is coupled to a base (108) and has at least one side plate (104) adjacent thereto. A clamping mechanism (200) fixes the side plate (104) to the support plate (102) so sheet metal (118) can be formed.

42 Claims, 3 Drawing Sheets

SYSTEM AND METHOD FOR FORMING SHEET METAL USING A RECONFIGURABLE TOOL

TECHNICAL FIELD OF THE INVENTION

This invention relates generally to the field of sheet metal forming and, more specifically, to a system and method for forming sheet metal using a reconfigurable tool.

BACKGROUND OF THE INVENTION

Conventional monolithic dies are used in the forming of metal parts such as sheet metal aircraft wing and control surface leading edge components. Such dies are manufactured by machining or casting a solid block with a specific surface designed only to manufacture a part of that same shape. Such dies are costly, bulky, require much setup time at the form press prior to commencement of manufacturing, and utilize large amounts of storage space when not in a production mode. Furthermore, leading edge parts tend to "springback" a great deal due to the nature of the materials used and stresses induced during manufacturing. These sprungback parts end up being ill fitting and require rework for proper fit into the next assembly. Rework most often requires that the die shape be changed before the part is reworked. This significantly increases costs.

A conventional reconfigurable tooling approach could allow the die shape to be efficiently changed to negate springback errors. This would allow a manufacturer to have a single die to manufacture many parts of varying shape, thus eliminating tool design and reducing fabrication costs. However, due to the relatively tight radii of sheet metal leading edge structures, combined with a steep "pull-off" angle at their edges, a conventional reconfigurable tooling approach is not suitable for the forming of sheet metal leading edge structures. This is because the bulky containment boxes required for housing the reconfigurable elements interferes with the forming machine. Furthermore, the length of sheet metal leading edge structures would require a large number of reconfigurable elements since round or square pins are typically used for the reconfigurable elements. This would add cost to the reconfigurable tool.

The challenges in the field of metal forming have continued to increase with demands for more and better techniques having greater flexibility and adaptability. Therefore, a need has arisen for a new system and method for forming leading edge structures using a reconfigurable tool.

SUMMARY OF THE INVENTION

In accordance with the present invention, a system and method for forming plates using a reconfigurable tool is provided that substantially eliminates or reduces disadvantages and problems associated with previously developed systems and methods.

A system for forming sheet metal is disclosed. The system comprises a support plate that is coupled to a base and has at least one side plate adjacent thereto. A clamping mechanism fixes the side plate to the support plate so sheet metal can be formed.

A method for constructing a forming tool is disclosed. The method comprises three steps. Step one calls for positioning a support plate on a base. Step two requires positioning at least one side plate next to the support plate. The last step calls for coupling the side plate to the support plate.

A method for forming sheet metal is also disclosed. The method comprises seven steps. Step one calls for coupling a support plate to a base. Step two requires positioning at least one side plate adjacent to the support plate. Step three provides coupling at least one actuator to the side plate. Step four calls for coupling the side plate to the support plate, and step five requires placing an interpolating layer on top of both the support plate and the side plate. Step six provides setting the sheet metal on top of the interpolating layer. The last step calls for gripping the sheet metal and forming the sheet metal over the interpolating layer, the support plate, and the side plate.

A technical advantage of the present invention is that a reconfigurable tool can be used to efficiently and economically eliminate springback errors resulting from forming leading edges structures. When springback occurs, the plate elements of the reconfigurable tool can be quickly reconfigured to rework the sheet metal to the desired shape.

Another technical advantage of the present invention is that a novel tool geometry is used to construct leading edge structures. The reconfigurable tool for use in the present invention contemplates using plates for the reconfigurable elements to allow an efficient and economical way of producing a wide range of leading edge structures. A variety of depths, cross-sections, or radii can be formed depending on the combination of support plates and side plates used.

An additional technical advantage of the present invention is that the support plates and side plates are interchangeable. Therefore, a setup consisting of a specific set of side plates can represent a "family of tools" for manufacturing similar types of leading edge components.

A further technical advantage of the present invention is that the reconfigurable tool is containerless. A typical reconfigurable tool has a container which houses the reconfigurable elements and their corresponding actuating mechanisms. The typical container would interfere with the forming press when constructing leading edge structures. The present invention contemplates having no container for housing any actuating mechanisms for the side plates.

A still further technical advantage of the present invention is that an internal clamping arrangement can be used to secure the side plates to the support plate. This helps to eliminate any possible interference problems when forming sheet metal.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF THE INVENTION

The preferred embodiments of the present invention and its advantages are best understood by referring now in more detail to FIGS. 1–5 of the drawings, in which like numerals refer to like parts.

Figure 1:
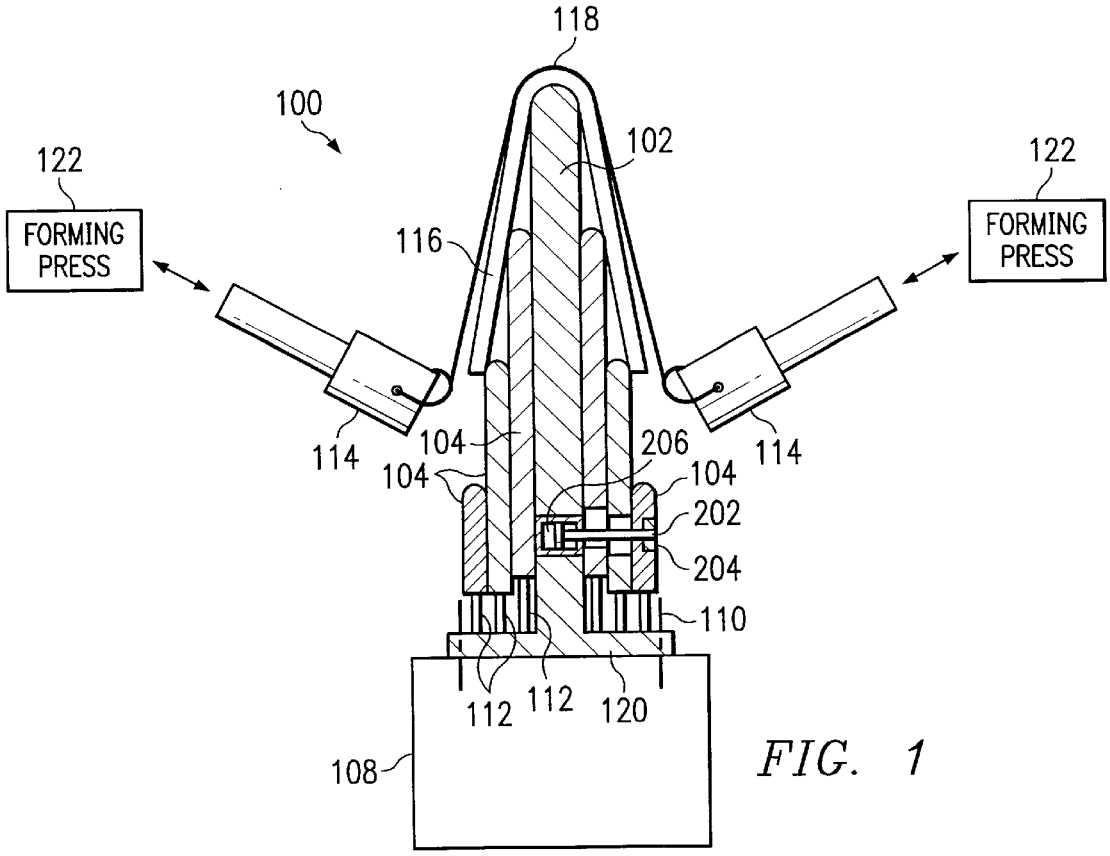
FIG. 1 is a cross-sectional view of the reconfigurable tool system of the present invention.

FIG. 1 is a cross-sectional view of a reconfigurable tool ("RT") 100 in accordance with the present invention. A support plate 102 is coupled to a base 108. Support plate 102 is shown in FIG. 1 to have a shape of an inverted "T". The bottom portion of support plate 102 is a flange 120 which preferably has holes to accept bolt 110, thereby bolting support plate 102 to base 108. Support plate 102 is typically made of structural steel with a plate thickness of one to two inches. However, any type of rigid material and thickness may be used as long as it can withstand the loads applied when forming a metal sheet 118 to a desired shape. Support plate 102 may have many different shapes and may be attached to base 108 using other fasteners or methods of attachment without departing from the scope of the present invention. Bolts 110 are preferred because of their simplicity, low cost, and ability to be removed and reattached in an efficient manner. Base 108 is typically a die table. Die tables are well known in the art of forming sheet metal and plate material using a press.

As shown in FIG. 1, support plate 102 has side plates 104 adjacent thereto. Side plates 104 are coupled to support plate 102 by a clamping mechanism 200. Side plates 104 are plates similar to support plate 102 in that they are generally made of structural material. As in the case of support plate 102, side plates 104 may also be other types of rigid material. Side plates 104 are generally one quarter to one inch thick. Any thickness, however, may be used. The combination and arrangement of side plates 104 depend on the final shape of metal sheet 118 desired. For example, there may exist only one side plate 104 on either side, or both sides, of support plate 102. There also may be many plates on either side, or both sides, of support plate 102. Additionally, there may be three side plates 104 on one side of support plate 102, while the other side of support plate 102 has two side plates 104. Or there may be, for instance, five side plates on both sides of support plate 102. Again, the number of side plates is flexible depending on the final shape desired. The function of clamping mechanism 200, which is described in greater detail below, is to secure side plates 104 to the sides of support plate 102.

Side plates 104 can be positioned next to support plate 102 either manually or automatically before clamping mechanism 200 is utilized. However, an actuator 112 is preferably employed to fix the location of side plate 104 with respect to support plate 102. Actuator 112 may comprise, for example, an electric motor coupled to a lead screw. Alternatively, actuator 112 may be driven by hydraulic or pneumatic mechanisms. Other actuating mechanisms are also contemplated. Actuator 112 is located in a manner that would avoid an interference between forming press grips 114 and actuator 112. An important technical advantage of the present invention is that RT 100 of the present invention is containerless. This differs from a typical reconfigurable tool that normally has a container which houses the reconfigurable elements, or pins, and their corresponding actuating mechanisms. This allows metal sheet 118 to be formed by forming press 122 and grips 114 without any interference with a container that is typical of many reconfigurable tools.

Another important technical advantage of the present invention is that RT 100 has plates instead of pins for its reconfigurable elements. Different combinations of support plates 102 and side plates 104 may be used depending on the details of the leading edge structure desired. This "family of tools" approach will allow a wide range of leading edge structures to be formed. Many different leading edge structure depths, widths, pull-off angles, and leading edge radii may be formed. As an example, a leading edge structure that is approximately twenty feet long with a one inch leading edge radius can be formed using the present invention. If typical reconfigurable tooling pins, either round or square, were used in RT 100 of the present invention, then the cost of RT 100 would be too high and the forming process uneconomical.

Before forming metal sheet 118, an interpolating layer 116 is draped over support plate 102 and side plates 104. Interpolating layers are well known in the art of reconfigurable tooling. Interpolating layer 116 is typically a flexible material such as a polymer, urethane, rubber, or neoprene. In order to form metal sheet 118, grips 114 that are attached to forming press 122 are used to grip the ends of metal sheet 118. Metal sheet 118 is then stretched, wrapped, or drawn over RT 100 to produce the desired shape of metal sheet 118. Grips 114 are well known in the art of stretch forming, and as mentioned previously, are attached to forming press 122, which generally has a capacity between 100 and 1,000 tons. Many different types and sizes of forming press 122 are contemplated by the present invention depending on the material type, size, and final shape of metal sheet 118. Metal sheet 118 is generally made of sheet metal that will be used in aircraft wing sections and control surface leading edge components. However, the present invention contemplates the forming of any type of material that comes in a plate or sheet form. Because of the containerless nature of RT 100, grips 114 do not have to contend with a bulky containment box that is typical in present reconfigurable tooling.

An additional advantage of the present invention is the efficient and economical negation of springback errors. Springback is the elastic recovery of the material that occurs when the forming load is removed from metal sheet 118. To correct springback when using conventional monolithic dies in the forming of metal sheets 118, the existing monolithic die would be re-machined to a compensated shape, or a new monolithic die with a compensated shape would have to be created. This means significant extra time and cost, and in the later case, extra tooling. In the present invention, if springback occurs, then RT 100 may be efficiently reconfigured to a different profile in order to negate the springback effect. Furthermore, less dies are needed for the present invention, which means less storage space required at the manufacturing plant.

Figure 2:
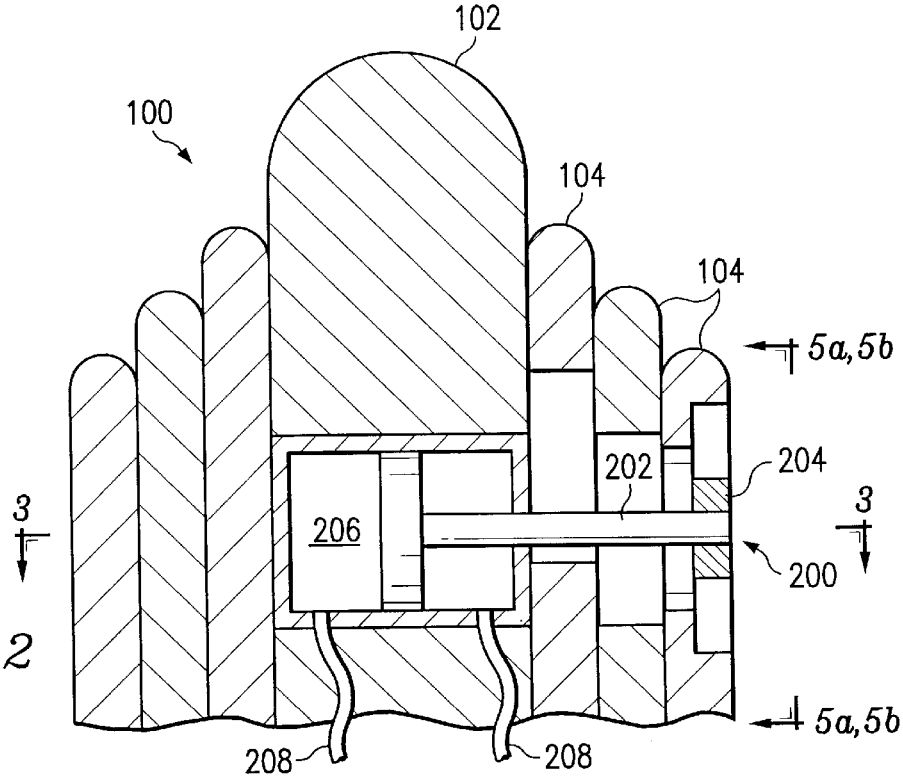
FIG. 2 is a cross-sectional view of the reconfigurable tool of the present invention showing, in greater detail, a clamping mechanism useful in the practice of the present invention.
Figure 5A:
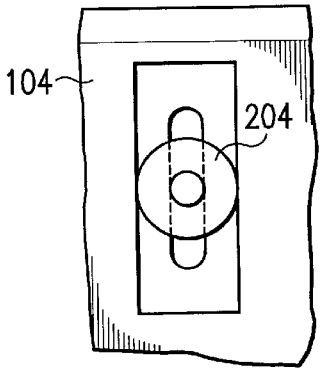
FIG. 5*a* is an elevational view showing one embodiment of the anchor end of a clamping mechanism useful in the practice of the present invention.
Figure 5B:
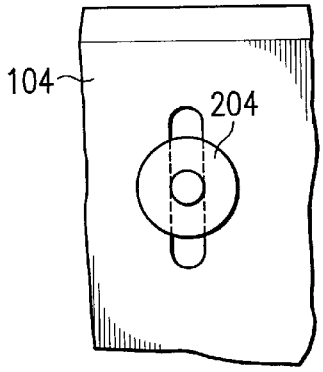
FIG. 5*b* is an elevational view showing an alternative embodiment of the anchor end of a clamping mechanism useful in the practice of the present invention.

Referring to FIG. 2, clamping mechanism 200 is shown in greater detail. In one embodiment, clamping mechanism 200 comprises a hydraulic cylinder 206, a piston 202, an anchor 204, and hydraulic conduits 208. Hydraulic conduits 208 are hoses for the hydraulic fluid that is used to move piston 202, and enter either from the bottom or ends of support plate 102. Hydraulic cylinder 206 is housed within an opening in support plate 102, and the head of piston 202 is housed within hydraulic cylinder 206. The shaft of piston 202 extends through one end of hydraulic cylinder 206, through openings in side plates 104, until it reaches the outer surface of the outermost side plate 104. The shaft of piston 202 is then coupled to anchor 204, which is either embedded in the outermost side plate 104 as shown in FIG. 5*a,* or sliding in a channel in the outermost side plate 104 as shown in FIG. 5*b.* Anchor 204 may comprise, for example, a threaded nut with or without a washer, or it may be integral with the shaft of piston 202, resulting in no separate anchor 204.

To couple side plates 104 to support plate 102, hydraulic fluid passes through hydraulic conduit 208 into the portion of hydraulic cylinder 206 that would push piston 202 in a direction that tightens side plates 104 to support plate 102. To release side plates 104 so they can be repositioned or removed, hydraulic fluid will pass through the other hydraulic conduit 208 into the portion of hydraulic cylinder 206 that would push piston 202 in a direction that loosens side plates 104 from support plate 102. Another way to release side plates 104 is to have a spring inside hydraulic cylinder 206 to push the piston in the desired direction. This would require only one hydraulic conduit 208 for coupling side plate 104 to support plate 102. Other clamping arrangements are contemplated by the present invention, such as electronic or pneumatic mechanisms housed within support plate 102, a shaft with a worm screw, or other hydraulic mechanisms. Whatever clamping mechanism 200 is used, it is desirable to avoid any interferences between clamping mechanism 200 and grips 114 of forming press 122.

Figure 3:
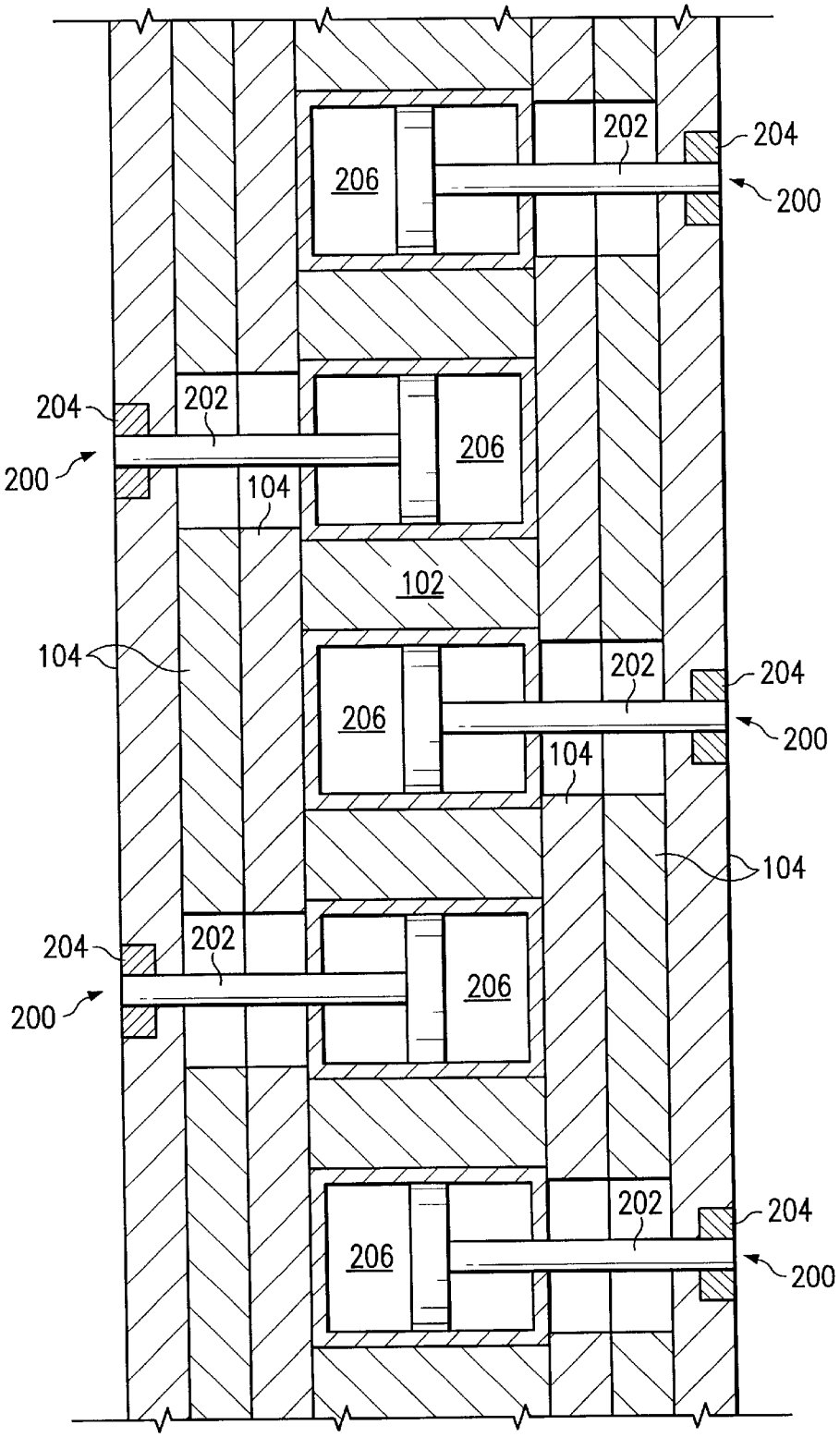
FIG. 3 is a cross-sectional view of the reconfigurable tool of the present invention showing a clamping mechanism arrangement useful in the practice of the present invention.

FIG. 3 shows a clamping mechanism arrangement useful in one embodiment of the present invention. A staggered arrangement results in a uniform clamping pressure along the length of RT 100. Other clamping mechanism arrangements are contemplated for other embodiments of the present invention. The clamping mechanism arrangement desired is dependent on such things as the length of RT 100, the thickness of support plate 102, the thickness and number of side plates 104, as well as the type of clamping arrangement 200 used.

Figure 4:
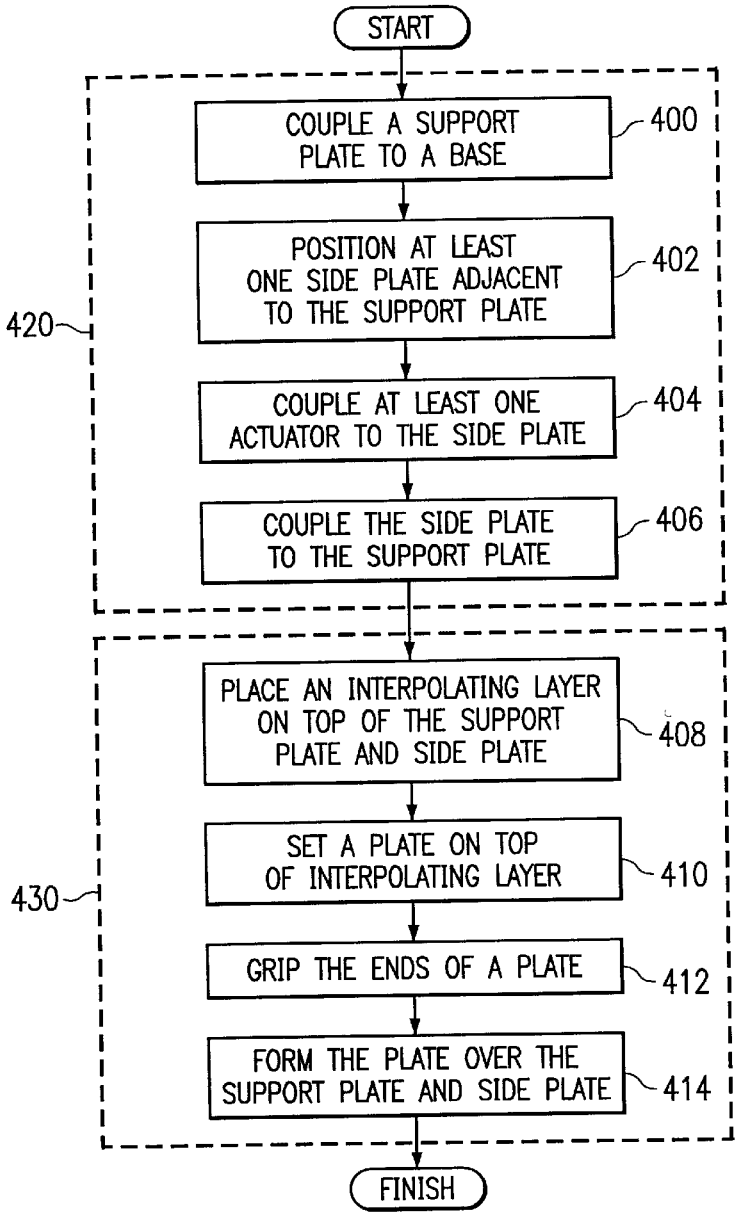
FIG. 4 is a flowchart demonstrating one method of forming sheet metal in accordance with the present invention.

FIG. 4 is a flowchart demonstrating one method of forming sheet metal in accordance with the present invention. A forming tool is constructed at step 420 before metal sheet 118 is formed at step 430 using the forming tool. The step of constructing a forming tool comprises the sub-steps of coupling support plate 102 to base 108 at step 400, positioning at least one side plate 104 adjacent to support plate 102 at step 402, coupling actuator 110 to side plate 104 at step 404, and coupling side 104 to support plate 102 at step 406. The step of forming metal sheet 118 using the forming tool comprises the sub-steps of placing resilient interpolating layer 116 on top of support plate 102 and side plate 104 at step 408, setting metal sheet 118 on top of resilient interpolating layer 116 at step 410, gripping the ends of metal sheet 118 using forming press grips 114 at step 412, and forming metal sheet 118 over support plate 102 and side plate 104 at step 414.

Although an embodiment of the invention and its advantages are described in detail, a person skilled in the art could make various alternations, additions, and omissions without departing from the spirit and scope of the present invention as defined by the appended claims.

What is claimed is:

1. An apparatus for forming sheet metal, comprising:

a base;

a support plate having two sides, a distal end, and coupled to the base at a proximate end;

at least one side plate adjacent one side of the support plate, the side plate having a thickness, a height substantially greater than the thickness, and a length substantially greater than the height;

an actuator coupled to the side plate, the actuator operable to fix a location of the side plate relative to the support plate; and a clamping mechanism coupling the side plate to the support plate.

2. The apparatus of claim 1 further comprising an interpolating layer adjacent the support plate distal end.

3. The apparatus of claim 2 wherein the interpolating layer is a resilient material.

4. The apparatus of claim 1 wherein the base is a die table.

5. The apparatus of claim 1 wherein the support plate includes a flange proximate the proximate end that is bolted to the base.

6. The apparatus of claim 1 further comprising a plurality of side plates wherein the side plates adjacent one side of the support plate are equal to the side plates on the opposite side of the support plate.

7. The apparatus of claim 1 further comprising a plurality of side plates wherein the side plates adjacent one side of the support plate are not equal to the side plates on the opposite side of the support plate.

8. An apparatus for forming sheet metal, comprising:

a base;

a support plate having two sides, a distal end and coupled to the base at a proximate end;

at least one side plate adjacent one side of the support plate; and a clamping mechanism coupling the side plate to the support plate, wherein the support plate and the side plate have openings housing the clamping mechanism, the clamping mechanism comprising:

at least one hydraulic conduit;

a hydraulic cylinder in fluid coupling with the hydraulic conduit; and a piston coupled to the hydraulic cylinder.

9. An apparatus for forming sheet metal, comprising:

a base;

a support plate having two sides, a distal end, and a proximate end having a flange that is coupled to the base;

at least one side plate adjacent one side of the support plate, the side plate having a thickness, a height substantially greater than the thickness, and a length substantially greater than the height;

at least one actuator coupled between the side plate and the flange for fixing a location of the side plate relative to the support plate; and a clamping mechanism coupling the side plate to the support plate.

10. The apparatus of claim 9 further comprising an interpolating layer adjacent the support plate distal end.

11. The apparatus of claim 10 wherein the interpolating layer is a resilient material.

12. The apparatus of claim 9 wherein the base is a die table.

13. The apparatus of claim 9 wherein the flange is bolted to the base.

14. The apparatus of claim 9 further comprising a plurality of side plates wherein the side plates adjacent one side of the support plate are equal to the side plates on the opposite side of the support plate.

15. The apparatus of claim 9 further comprising a plurality of side plates wherein the side plates adjacent one side of the support plate are equal to the side plates on the opposite side of the support plate.

16. The apparatus of claim 9 wherein the actuator is an electric motor coupled to a lead screw.

17. The apparatus of claim 9 wherein the actuator is a hydraulic actuator.

18. The apparatus of claim 9 wherein the actuator is a pneumatic actuator.

19. An apparatus for forming sheet metal, comprising:

a base;

a support plate having two sides, a distal end and coupled to the base at a proximate end;

at least one side plate adjacent one side of the support plate;

at least one actuator coupled to the side plate for fixing a location of the side plate relative to the support plate; and a clamping mechanism coupling the side plate to the support plate, wherein the support plate and the side plate have openings housing the clamping mechanism, the clamping mechanism comprising:

at least one hydraulic conduit;

a hydraulic cylinder in fluid coupling with the hydraulic conduit; and a piston coupled to the hydraulic cylinder.

20. A method for constructing a forming tool, the method comprising:

coupling a support plate having sides to a base;

positioning at least one side plate adjacent one side of the support plate, the side plate having a thickness, a height substantially greater than the thickness, and a length substantially greater than the height;

coupling an actuator between the side plate and the base, the actuator operable to actuate the side plate relative to the support plate; and coupling the side plate to the support plate.

21. The method of claim 20 wherein the base is a die table.

22. The method of claim 20 wherein the step of coupling the support plate having sides to the base comprises bolting a flange of the support plate to the base.

23. The method of claim 20 wherein the step of positioning at least one side plate adjacent the support plate comprises positioning a plurality of side plates adjacent one side of the support plate and an equal plurality of side plates on an opposite side of the support plate.

24. The method of claim 20 wherein the step of positioning at least one side plate adjacent the support plate comprises positioning a plurality of side plates adjacent one side of the support plate and an unequal plurality of side plates on an opposite side of the support plate.

25. The method of claim 20 wherein the step of coupling the side plate to the support plate comprises using a clamping mechanism, the clamping mechanism comprising:

at least one hydraulic conduit;

a hydraulic cylinder in fluid coupling with the hydraulic conduit; and a piston coupled to the hydraulic cylinder.

26. The method of claim 20 wherein the actuator is an electric motor coupled to a lead screw.

27. The method of claim 20 wherein the actuator is a hydraulic actuator.

28. The method of claim 20 wherein the actuator is a pneumatic actuator.

29. A method for forming sheet metal, the method comprising:

coupling a flange of a support plate having two sides and a distal end to a base at a proximate end;

positioning at least one side plate adjacent one side of the support plate, the side plate having a distal end, the side plate also having a thickness, a height substantially greater than the thickness, and a length substantially greater than the height;

coupling at least one actuator between the side plate and the flange;

coupling the side plate to the support plate;

placing an interpolating layer adjacent the distal end of the support plate and the distal end of the side plate;

setting a metal sheet adjacent the interpolating layer; and gripping the metal sheet to form the metal sheet using the interpolating layer, the distal end of the support plate, and the distal end of the side plate.

30. The method of claim 29 wherein the base is a die table.

31. The method of claim 29 wherein the step of coupling the flange of the support plate comprises bolting the flange of the support plate to the base.

32. The method of claim 29 wherein the step of positioning at least one side plate adjacent the support plate comprises positioning a plurality of side plates adjacent one side of the support plate and an equal plurality of side plates on an opposite side of the support plate.

33. The method of claim 29 wherein the step of positioning at least one side plate adjacent the support plate comprises positioning a plurality of side plates adjacent one side of the support plate and an unequal plurality of side plates on an opposite side of the support plate.

34. The method of claim 29 wherein the actuator is an electric motor coupled to a lead screw.

35. The method of claim 29 wherein the actuator is a hydraulic actuator.

36. The method of claim 29 wherein the actuator is a pneumatic actuator.

37. The method of claim 29 wherein the step of coupling the side plate to the support plate comprises using a clamping mechanism, the clamping mechanism comprising:

at least one hydraulic conduit;

a hydraulic cylinder in fluid coupling with the hydraulic conduit; and a piston coupled to the hydraulic cylinder.

38. The method of claim 29 wherein the interpolating layer is a resilient material.

39. The method of claim 29 wherein the step of gripping the metal sheet comprises bending the metal sheet over the distal end of the support plate until the metal sheet touches the side plate.

40. An apparatus for forming sheet metal, comprising:

a die table;

a support plate having two sides and a flange, the flange coupled to the die table, the support plate having a thickness, a height substantially greater than the thickness, and a length substantially greater than the height;

at least one side plate adjacent each side of the support plate, the side plates having a thickness, a height substantially greater than the thickness, and a length substantially greater than the height;

at least one actuator coupled to each side plate for fixing a location of the side plate relative to the support plate;

a clamping mechanism coupling each side plate to the support plate; and wherein a thickness of the support plate is thicker than a thickness of each of the side plates.

41. The apparatus of claim 40 wherein the support plate and each side plate have openings housing the clamping mechanism, the clamping mechanism comprising:

at least one hydraulic conduit;

a hydraulic cylinder in fluid coupling with the hydraulic conduit; and a piston coupled to the hydraulic cylinder.

42. The apparatus of claim 40, wherein the thickness of the support plate is one to two inches and the thickness of each side plate is one-quarter to one inch.

* * * * *